US012687330B2

(12) United States Patent
Arnou et al.

(10) Patent No.: US 12,687,330 B2
(45) Date of Patent: Jul. 21, 2026

(54) EXPANSION VALVE CONTROL SYSTEM

(71) Applicants: Johnson Controls Tyco IP Holdings LLP, Milwaukee, WI (US); Johnson Controls Industries SAS, Carquefou (FR)

(72) Inventors: Damien Jean Daniel Arnou, La Séguinière (FR); Francois Charles Andre Clunet, La Chapelle-sur-Erdre (FR); Paul Eric Le Sausse, Nantes (FR); Laurent Claude Eric Thibaud, Mouzillon (FR)

(73) Assignees: Tyco Fire & Security GmbH, Neuhausen am Rheinfall (CH); Johnson Controls Industries SAS, Carquefou (FR)

( * ) Notice: Subject to any disclaimer, the term of this patent is extended or adjusted under 35 U.S.C. 154(b) by 290 days.

(21) Appl. No.: 18/024,469

(22) PCT Filed: Sep. 3, 2021

(86) PCT No.: PCT/US2021/049120
§ 371 (c)(1),
(2) Date: Mar. 2, 2023

(87) PCT Pub. No.: WO2022/051655
PCT Pub. Date: Mar. 10, 2022

(65) Prior Publication Data

US 2023/0324093 A1 Oct. 12, 2023

Related U.S. Application Data

(60) Provisional application No. 63/074,309, filed on Sep. 3, 2020.

(51) Int. Cl.
*F25B 41/31* (2021.01)

(52) U.S. Cl.
CPC ..... *F25B 41/31* (2021.01); *F25B 2339/024* (2013.01); *F25B 2339/046* (2013.01);
(Continued)

(58) Field of Classification Search
CPC ..... F25B 41/31; F25B 2339/024; F25B 2339/046; F25B 2600/2513;
(Continued)

(56) References Cited

U.S. PATENT DOCUMENTS 4,499,739 A * 2/1985 Matsuoka ..... G05D 23/1917 62/196.3
4,523,435 A * 6/1985 Lord ..... G05D 23/24 236/78 D
(Continued)

FOREIGN PATENT DOCUMENTS

CA 2820316 A1 * 12/2013 ..... F25B 41/34
EP 1134518 A2 9/2001
(Continued)

OTHER PUBLICATIONS

JP-2010054094-A, machine translation (Year: 2025).*
(Continued)

*Primary Examiner* — Eric S Ruppert
*Assistant Examiner* — Kirstin U Oswald
(74) *Attorney, Agent, or Firm* — Fletcher Yoder, P.C.

(57) ABSTRACT

A vapor compression system includes a heat exchanger configured to facilitate heat transfer between a refrigerant and a conditioning fluid. The vapor compression system also includes an expansion valve disposed along a conduit coupled to the heat exchanger. The conduit is configured to direct a flow of the refrigerant into the heat exchanger. Additionally, the vapor compression system includes a sensor configured to provide feedback indicative of a temperature of the conditioning fluid exiting the heat exchanger and
(Continued)

a controller including a memory and processing circuitry. The processing circuitry is configured to receive a signal indicative of the temperature of the conditioning fluid exiting the heat exchanger from the sensor and adjust operation of the expansion valve based on the signal.

18 Claims, 6 Drawing Sheets

(52) U.S. Cl.
CPC . *F25B 2600/2513* (2013.01); *F25B 2700/197* (2013.01); *F25B 2700/21175* (2013.01)

(58) Field of Classification Search
CPC ..... F25B 2700/197; F25B 2700/21175; F25B 2500/19; F25B 2600/05; F25B 2600/2509; F25B 25/005; F25B 2400/13; F25B 2700/1933; F25B 49/02
USPC ..... 62/115
See application file for complete search history.

(56) References Cited

U.S. PATENT DOCUMENTS 4,715,190 A * 12/1987 Han ..... F25B 49/022 62/201
5,632,154 A * 5/1997 Sibik ..... F25B 41/34 62/99
6,318,101 B1 * 11/2001 Pham ..... F25B 41/34 62/225
6,711,911 B1 * 3/2004 Grabon ..... F25B 41/35 62/175
9,797,640 B2 * 10/2017 Umeda ..... F25B 49/022
2005/0126190 A1 * 6/2005 Lifson ..... F25B 49/005 62/149
2010/0101247 A1 * 4/2010 Lifson ..... F25B 49/022 62/115
2010/0101248 A1 * 4/2010 Lifson ..... F25B 49/02 700/275
2010/0281894 A1 * 11/2010 Huff ..... F25B 9/008 62/115
2014/0326002 A1 * 11/2014 Sunderland ..... F25B 49/027 62/190
2016/0076821 A1 * 3/2016 Kopko ..... F28D 20/0039 165/10
2017/0191718 A1 * 7/2017 Kohler ..... F25B 39/028
2018/0031253 A1 * 2/2018 McCune ..... F25B 5/04
2018/0031288 A1 * 2/2018 Hern ..... F25B 41/35
2018/0149397 A1 * 5/2018 Wolgamot ..... F25B 49/027
2018/0209709 A1 7/2018 Matsukura et al.
2019/0203999 A1 * 7/2019 Kulankara ..... F25B 45/00

FOREIGN PATENT DOCUMENTS

JP H08145482 A 6/1996
JP 2010054094 A * 3/2010
JP 2016114299 A 6/2016
KR 20150051982 A 5/2015

OTHER PUBLICATIONS

International Search Report and Written Opinion for PCT Application No. PCT/US2021/049120, mailed Dec. 20, 2021, 10 pages.
European Extended Search Report for EP Application No. 21865217.0, dated Sep. 3, 2024, 9 pages.

* cited by examiner

EXPANSION VALVE CONTROL SYSTEM

CROSS REFERENCE TO RELATED APPLICATIONS

This application is a U.S. National Stage Application of PCT International Application No. PCT/US2021/049120, entitled "EXPANSION VALVE CONTROL SYSTEM." filed Sep. 3, 2021, which claims priority to and the benefit of U.S. Provisional Patent Application No. 63/074,309, entitled "EXPANSION VALVE CONTROL SYSTEM," filed Sep. 3, 2020, each of which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, air conditioning, and/or refrigeration (HVAC&R) systems are used in a variety of settings and for many purposes. For example, HVAC&R systems may include a vapor compression system (e.g., a refrigerant circuit having a condenser, an evaporator, a compressor, and/or an expansion device) configured to enable conditioning of an environment. The vapor compression system may circulate a working fluid, such as a refrigerant, which may change phases between vapor, liquid, and combinations thereof in response to heat transfer with other fluids, such as a water flow or air flow. That is, the refrigerant may undergo different temperature and pressure changes as the refrigerant is circulated through the refrigerant circuit and exchanges heat with one or more fluids associated with operation of the vapor compression system. Unfortunately, existing HVAC&R systems may not adequately control a phase of the refrigerant at various locations along the refrigerant circuit, such as within the condenser and/or within the evaporator, which may decrease performance of the HVAC&R systems.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment of the present disclosure, a vapor compression system includes a heat exchanger configured to facilitate heat transfer between a refrigerant and a conditioning fluid. The vapor compression system includes an expansion valve disposed along a conduit coupled to the heat exchanger. The conduit is configured to direct a flow of the refrigerant into the heat exchanger. Additionally, the vapor compression system includes a sensor configured to provide feedback indicative of a temperature of the conditioning fluid exiting the heat exchanger and a controller including a memory and processing circuitry. The processing circuitry is configured to receive a signal indicative of the temperature of the conditioning fluid exiting the heat exchanger from the sensor and adjust operation of the expansion valve based on the signal.

In another embodiment of the present disclosure, a vapor compression system includes a condenser configured to transfer heat from a refrigerant to a cooling fluid, an evaporator configured to transfer heat from the refrigerant to a conditioning fluid, an expansion valve configured to direct the refrigerant from the condenser to the evaporator, a sensor configured to provide feedback indicative of a temperature of the conditioning fluid exiting the evaporator, and a controller including a memory and processing circuitry. The processing circuitry is configured to receive a signal from the sensor indicative of the temperature of the conditioning fluid exiting the evaporator and adjust operation of the expansion valve based on the signal.

In a further embodiment of the present disclosure, a method of controlling an expansion valve of a vapor compression system includes detecting a temperature of a conditioning fluid exiting a heat exchanger, determining a difference between the temperature of the conditioning fluid and a saturated temperature of a refrigerant within the heat exchanger, adjusting the expansion valve toward a closed position based a determination that the difference is less than a difference set point, and adjusting the expansion valve toward an open position based on a determination that the difference is greater than the difference set point.

BRIEF DESCRIPTION OF THE DRAWINGS

Various aspects of this disclosure may be better understood upon reading the following detailed description and upon reference to the drawings in which.

DETAILED DESCRIPTION

Figure 1:
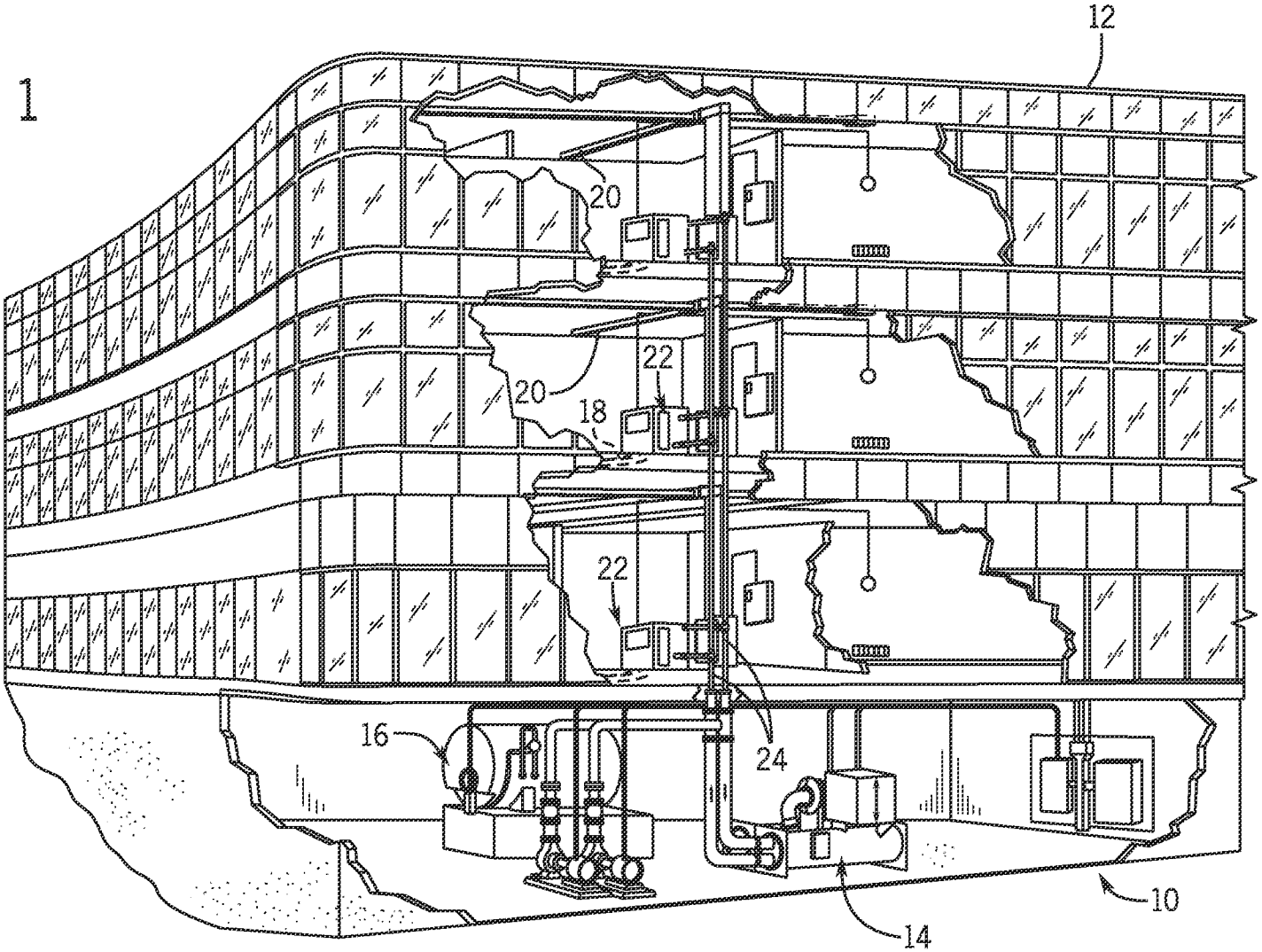
FIG. 1 is perspective view of a building that may utilize an embodiment of a heating, ventilation, air conditioning, and/or refrigeration (HVAC&R) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As briefly discussed above, a vapor compression system generally circulates a refrigerant (e.g., a working fluid) through a refrigerant circuit. The refrigerant may flow through multiple conduits and components disposed along the refrigerant circuit, while undergoing phase changes to enable the vapor compression system to condition a fluid flow (e.g., a water flow, an air flow, etc.), which may be supplied to an interior space of a structure in order to condition the interior space. For example, the vapor compression system generally includes a compressor that compresses a refrigerant vapor and delivers the refrigerant vapor to a condenser through a discharge passage. The refrigerant vapor may transfer heat to a cooling fluid (e.g., water or air) directed across or through the condenser and may condense to a refrigerant liquid as a result.

The vapor compression system also typically includes an evaporator and an expansion valve. The expansion valve is disposed along the refrigerant circuit generally between the condenser and the evaporator. The refrigerant liquid discharged from the condenser may flow through the expansion valve toward the evaporator. The refrigerant liquid delivered to the evaporator may absorb heat from a conditioning fluid directed across or through the evaporator, which may or may not be the same cooling fluid used in the condenser. Additionally, the refrigerant liquid in the evaporator may undergo a phase change (e.g., evaporate) from the refrigerant liquid to a refrigerant vapor. The refrigerant vapor exits the evaporator and is returned to the compressor to complete the cycle along the refrigerant circuit.

In certain embodiments, the vapor compression system includes an intermediate circuit extending between the condenser and the expansion valve (e.g., a first, downstream expansion valve). The intermediate circuit may include an intermediate vessel, and a second expansion valve (e.g., a second, upstream expansion valve) may be positioned between the condenser and the intermediate vessel along the intermediate circuit. In some embodiments, the intermediate vessel may be a flash tank (e.g., a flash intercooler). In other embodiments, the intermediate vessel may be configured as a heat exchanger or a "surface economizer." The second expansion valve may lower the pressure of (e.g., expand) the refrigerant liquid received from the condenser. During the expansion process, a portion of the refrigerant liquid may vaporize, and thus, the intermediate vessel may operate to separate the refrigerant vapor from the refrigerant liquid received from the second expansion valve. Additionally, the intermediate vessel may provide for further expansion of the refrigerant liquid due to a pressure drop experienced by the refrigerant liquid upon entering the intermediate vessel (e.g., due to a rapid increase in volume as the refrigerant enters the intermediate vessel). The refrigerant vapor in the intermediate vessel may be drawn into the compressor. The refrigerant liquid within the intermediate vessel may have a lower enthalpy than the refrigerant liquid exiting the condenser due to the refrigerant expansion at the second, upstream expansion valve and/or within the intermediate vessel. The refrigerant liquid within the intermediate vessel may then flow through the first, downstream expansion valve to the evaporator.

In some embodiments, the vapor compression system may include a liquid level sensor within or at the condenser, and the liquid level sensor may be configured to sense or detect a level (e.g., amount) of refrigerant liquid within the condenser. A controller of the vapor compression system may control an expansion valve (e.g., a position of the expansion valve) disposed along the refrigerant circuit based on a sensed level of the refrigerant liquid in the condenser. For example, in an embodiment of the vapor compression circuit having the intermediate circuit mentioned above, the controller may control the second, upstream expansion valve disposed along the intermediate circuit between the condenser and the intermediate vessel based on the detected liquid level, and/or the controller may control the first, downstream expansion valve disposed along the refrigerant circuit between the intermediate vessel and the evaporator. In an embodiment of the vapor compression circuit without the intermediate circuit, the controller may control the expansion valve disposed between the condenser and the evaporator based on the detected liquid level. In particular, the controller may adjust the expansion valve (e.g., a position of the expansion valve) to control or adjust the phase(s) of the refrigerant within the condenser and the evaporator. For example, based on the level of the liquid refrigerant in the condenser, the controller may open or close the expansion valve (e.g., move the expansion valve toward an open position or toward a closed position), thereby adjusting the pressure, temperature, and/or phase of the refrigerant in the condenser and/or the evaporator. As a result, refrigerant flow through the refrigerant circuit (e.g., within the condenser and/or evaporator) may be controlled and adjusted. By controlling the refrigerant flow along the refrigerant circuit (e.g., the intermediate circuit), the vapor compression system may improve performance of the vapor compression system, such as by increasing a capacity of the evaporator and the vapor compression system generally.

Sensing the level of refrigerant liquid in the condenser may be difficult due to shifting or moving of the refrigerant within the condenser, temperature and pressure changes of the refrigerant within the condenser, and other factors. As such, controlling the expansion valve of the vapor compression system based on feedback from a liquid level sensor within the condenser may result in undesired phase(s) or other properties of the refrigerant along certain portions of the refrigerant circuit. Accordingly, the present disclosure is directed to a system and method for controlling an expansion valve of a vapor compression system to at least partially adjust and/or maintain certain phase(s), pressure(s), and/or temperature(s) of the refrigerant within the refrigerant circuit, such as within the condenser and/or the evaporator. To this end, certain embodiments of the vapor compression system include a sensor (e.g., a temperature sensor) disposed at a conditioning fluid outlet (e.g., water outlet) of the evaporator that is configured to provide feedback indicative of a temperature of the condoning fluid at the outlet of the evaporator. Some embodiments of the vapor compression system include a sensor (e.g., a pressure sensor) disposed within/at the evaporator that is configured to provide feedback indicative of a pressure of the refrigerant within the evaporator. The controller of the vapor compression system may receive the feedback from the sensors indicative of the temperature of the conditioning fluid and the pressure of the refrigerant.

The controller may control an expansion valve (e.g., the first and/or second expansion valve disposed along the refrigerant circuit and generally between the condenser and the evaporator) based on the outlet temperature of the conditioning fluid and/or the pressure of the refrigerant within the evaporator. For example, the controller may determine a saturated temperature of the refrigerant within the evaporator based on the pressure of the refrigerant and may determine a difference (e.g., a small temperature difference) between the outlet temperature of the conditioning fluid and the saturated temperature of the refrigerant within the evaporator. The controller may also compare the calculated temperature difference to a set point or temperature difference reference value and then control the expansion valve based on the comparison. For example, based on the calculated temperature difference being greater than a temperature difference set point, the controller may open the expansion valve (e.g., adjust the expansion valve towards an open position and/or increase the size of a refrigerant flow path through the expansion valve). As a result, the pressure and/or saturated temperature of the refrigerant within the evaporator may be increased, and the temperature difference between the outlet temperature of the conditioning fluid and the saturated temperature of the refrigerant within the evaporator may be decreased. As another example, based on a determination that the calculated temperature difference is less than the temperature difference set point, the controller may close the expansion valve (e.g., adjust the expansion valve towards a closed position and/or decrease the size of a refrigerant flow path through the expansion valve). As a result, the pressure and/or saturated temperature of the refrigerant within the evaporator may be decreased, and the temperature difference between the outlet temperature of the conditioning fluid and the saturated temperature of the refrigerant within the evaporator may be increased.

Adjustment of the temperature difference toward a temperature difference set point may enhance an ability of the evaporator to exchange heat between the refrigerant and the conditioning fluid, which may thereby enhance the capacity of the evaporator. The temperature difference set point may be a pre-determined or specific set point at which the capacity of the evaporator is improved (e.g., increased). In some embodiments, the temperature difference set point may be determined by the controller based on a size and/or type of the evaporator, a type of the refrigerant, a type of the conditioning fluid, and/or other factors. Accordingly, as the controller adjusts operation of the expansion valve, operation and/or efficiency of the evaporator, and the vapor compression system generally, may improve. For example, the adjustments to the expansion valve may generally improve the operation of the evaporator at different operating capacities, such as based on detected operating conditions of the vapor compression system.

Some examples of fluids that may be used as refrigerants in embodiments of the present disclosure include hydrofluorocarbon (HFC) based refrigerants, such as R-410A, R-407, or R-134a, hydrofluoroolefin (HFO) based refrigerants, such as R-1233 or R-1234, "natural" refrigerants, such as ammonia (NH3), R-717, carbon dioxide (CO2), R-744, or hydrocarbon based refrigerants, water vapor, or any other suitable refrigerant. In some embodiments, the vapor compression system may be configured to efficiently utilize refrigerants having a normal boiling point of about 19 degrees Celsius (66 degrees Fahrenheit) at one atmosphere of pressure, also referred to as low pressure refrigerants, as compared to a medium pressure refrigerant, such as R-134a. As used herein, "normal boiling point" may refer to a boiling point temperature measured at one atmosphere of pressure. The cooling fluid(s) and/or conditioning fluid(s) of the vapor compression system may include water, ethylene glycol, calcium chloride brine, sodium chloride brine, or any other suitable fluid.

The control techniques of the present disclosure may be used in a variety of systems, such as water-cooled chiller systems, air-cooled chiller systems, heat pumps, refrigeration systems, and so forth. However, to facilitate discussion, examples of systems that may incorporate the techniques of the present disclosure are depicted in FIGS. 1-4, which are described herein below.

Turning now to the drawings, FIG. 1 is a perspective view of an embodiment of an environment for a heating, ventilation, air conditioning, and/or refrigeration (HVAC&R) system 10 in a building 12 for a typical commercial setting. The HVAC&R system 10 may include a vapor compression system 14 that supplies a chilled liquid, which may be used to cool the building 12. The HVAC&R system 10 may also include a boiler 16 to supply warm liquid to heat the building 12 and an air distribution system which circulates air through the building 12. The air distribution system can also include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the HVAC&R system 10. The HVAC&R system 10 is shown with a separate air handler on each floor of building 12, but in other embodiments, the HVAC&R system 10 may include air handlers 22 and/or other components that may be shared between or among floors.

Figure 2:
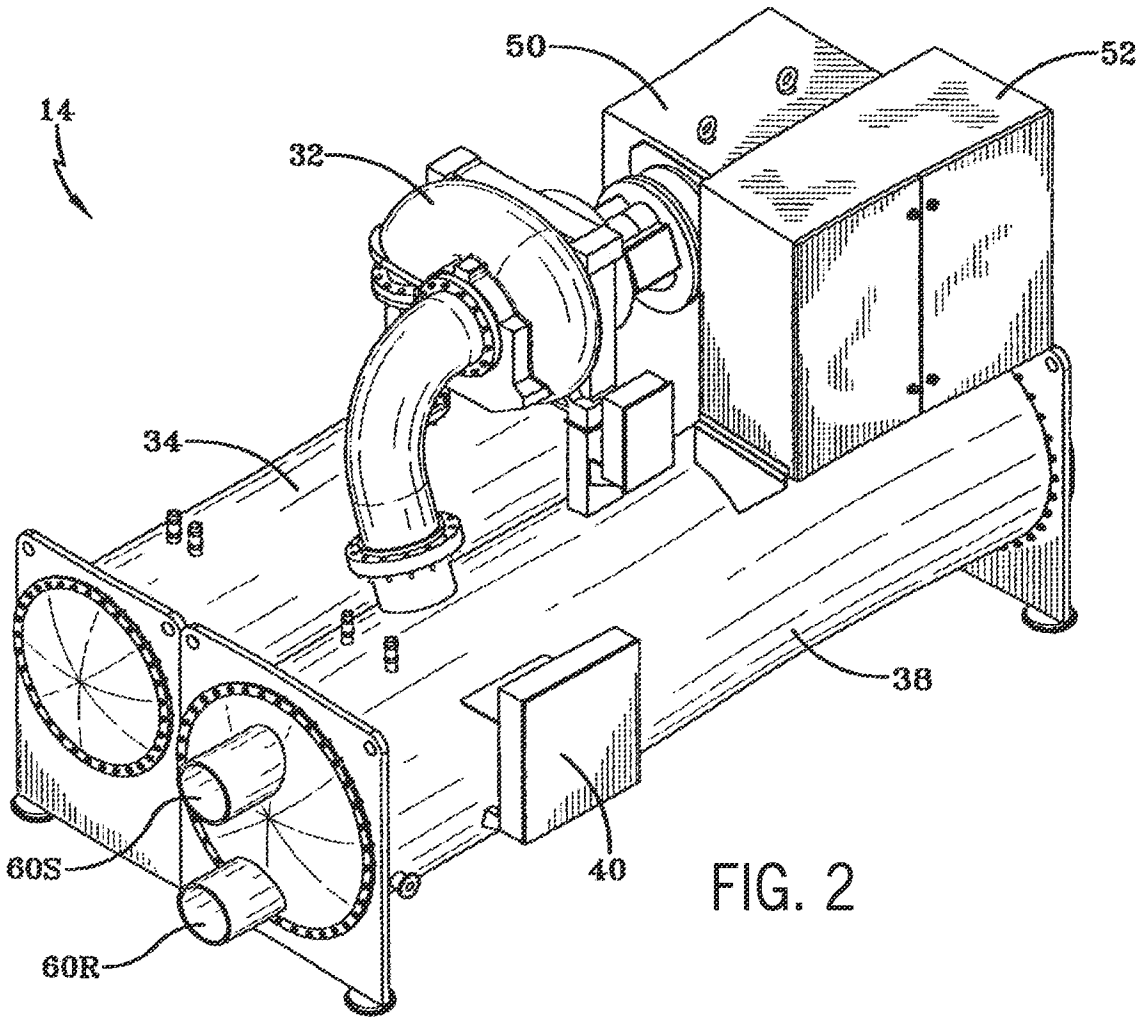
FIG. 2 is a perspective view of an embodiment of an HVAC&R system, in accordance with an aspect of the present disclosure.
Figure 3:
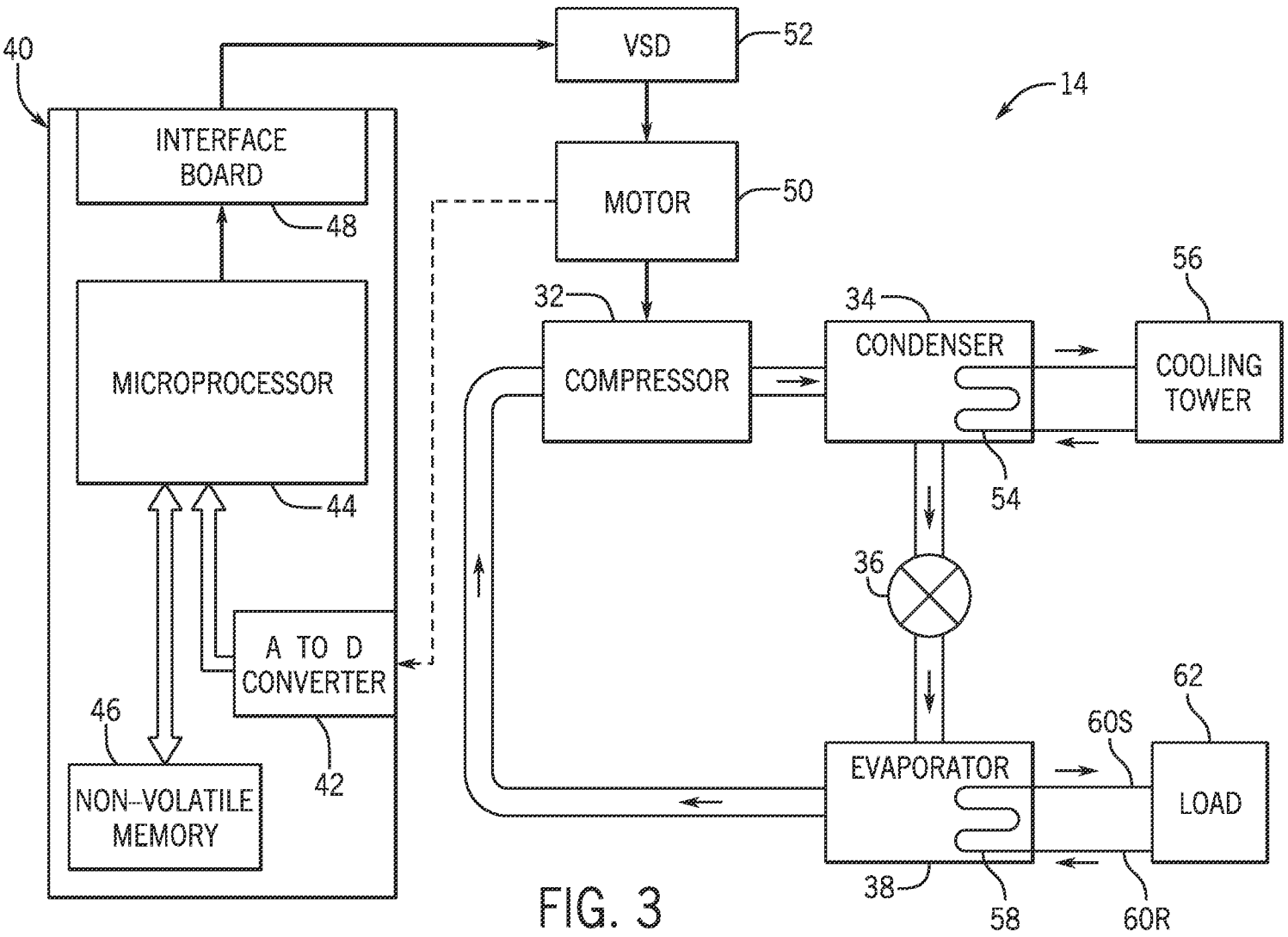
FIG. 3 is a schematic diagram of an embodiment of a vapor compression system, in accordance with an aspect of the present disclosure.

FIGS. 2 and 3 illustrate embodiments of the vapor compression system 14 which may be used in the HVAC&R system 10. The vapor compression system 14 may circulate a refrigerant through a circuit starting with a compressor 32. The circuit may also include a condenser 34, an expansion valve(s) or device(s) 36, and a liquid chiller or an evaporator 38. The vapor compression system 14 may further include a control panel 40 (e.g., a controller) that has an analog to digital (A/D) converter 42, a microprocessor 44, a non-volatile memory 46, and/or an interface board 48.

In some embodiments, the vapor compression system 14 may use one or more of a variable speed drive (VSDs) 52, a motor 50, the compressor 32, the condenser 34, the expansion valve or device 36, and/or the evaporator 38. The motor 50 may drive the compressor 32 and may be powered by a variable speed drive (VSD) 52. The VSD 52 receives alternating current (AC) power having a particular fixed line voltage and fixed line frequency from an AC power source, and provides power having a variable voltage and frequency to the motor 50. In other embodiments, the motor 50 may be powered directly from an AC or direct current (DC) power source. The motor 50 may include any type of electric motor that can be powered by a VSD or directly from an AC or DC power source, such as a switched reluctance motor, an induction motor, an electronically commutated permanent magnet motor, or another suitable motor.

The compressor 32 compresses a refrigerant vapor and delivers the vapor to the condenser 34 through a discharge passage. In some embodiments, the compressor 32 may be a centrifugal compressor. The compressor 32 includes a fluid (e.g., a lubricant oil) that lubricates components of the compressor 32. The refrigerant vapor delivered by the compressor 32 to the condenser 34 may transfer heat to a cooling fluid (e.g., water or air) in the condenser 34. The refrigerant vapor may condense to a refrigerant liquid in the condenser 34 as a result of thermal heat transfer with the cooling fluid. The refrigerant liquid from the condenser 34 may flow through the expansion valve 36 to the evaporator 38. In the illustrated embodiment of FIG. 3, the condenser 34 is water cooled and includes a tube bundle 54 connected to a cooling tower 56, which supplies the cooling fluid to the condenser 34.

The refrigerant liquid delivered to the evaporator 38 may absorb heat from another cooling fluid (e.g., a conditioning fluid, such as water or air), which may or may not be the same cooling fluid used in the condenser 34. The refrigerant liquid in the evaporator 38 may undergo a phase change from the refrigerant liquid to a refrigerant vapor. As shown in the illustrated embodiment of FIG. 3, the evaporator 38 may include a tube bundle 58 having a supply line 60S and a return line 60R connected to a cooling load 62. The cooling or conditioning fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. The evaporator 38 may reduce the temperature of the cooling or conditioning fluid in the tube bundle 58 via thermal heat transfer with the refrigerant. The tube bundle 58 in the evaporator 38 can include a plurality of tubes and/or a plurality of tube bundles. In any case, the refrigerant vapor exits the evaporator 38 and returns to the compressor 32 by a suction line to complete the cycle.

Figure 4:
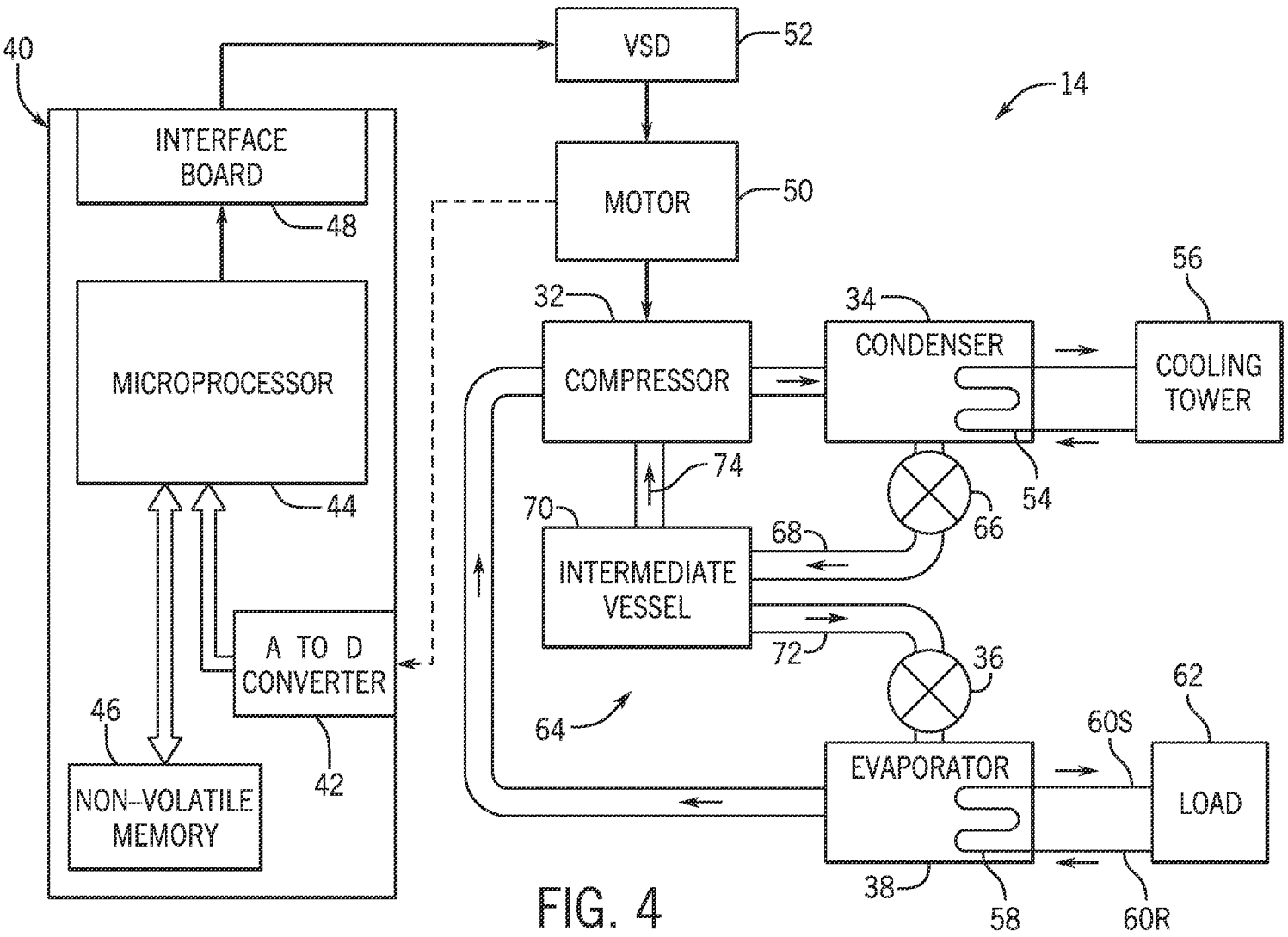
FIG. 4 is a schematic diagram of another embodiment of a vapor compression system, in accordance with an aspect of the present disclosure.

FIG. 4 is a schematic diagram of the vapor compression system 14 with an intermediate circuit 64 incorporated between condenser 34 and the expansion valve 36. The intermediate circuit 64 may have an inlet line 68 (e.g., a conduit) that is directly fluidly connected to the condenser 34. In other embodiments, the inlet line 68 may be indirectly fluidly coupled to the condenser 34. As shown in the illustrated embodiment of FIG. 4, the inlet line 68 includes a first expansion device 66 (e.g., first expansion valve) positioned upstream of an intermediate vessel 70. In some embodiments, the intermediate vessel 70 may be a flash tank (e.g., a flash intercooler). In other embodiments, the intermediate vessel 70 may be configured as a heat exchanger or a "surface economizer." In the illustrated embodiment of FIG. 4, the intermediate vessel 70 is used as a flash tank, and the first expansion device 66 is configured to lower the pressure of (e.g., expand) the refrigerant liquid received from the condenser 34. During the expansion process, a portion of the liquid may vaporize, and thus, the intermediate vessel 70 may be used to separate the vapor from the liquid received from the first expansion device 66. Additionally, the intermediate vessel 70 may provide for further expansion of the refrigerant liquid because of a pressure drop experienced by the refrigerant liquid when entering the intermediate vessel 70 (e.g., due to a rapid increase in volume experienced when entering the intermediate vessel 70). The vapor in the intermediate vessel 70 may be drawn by the compressor 32 through a suction line 74 (e.g., a conduit) of the compressor 32. In other embodiments, the vapor in the intermediate vessel may be drawn to an intermediate stage of the compressor 32 (e.g., not the suction stage). The liquid that collects in the intermediate vessel 70 may be at a lower enthalpy than the refrigerant liquid exiting the condenser 34 because of the expansion in the expansion device 66 and/or the intermediate vessel 70. The liquid from intermediate vessel 70 may then flow in line 72 (e.g., a conduit) through a second expansion device 36 (e.g., second expansion valve) to the evaporator 38.

Figure 5:
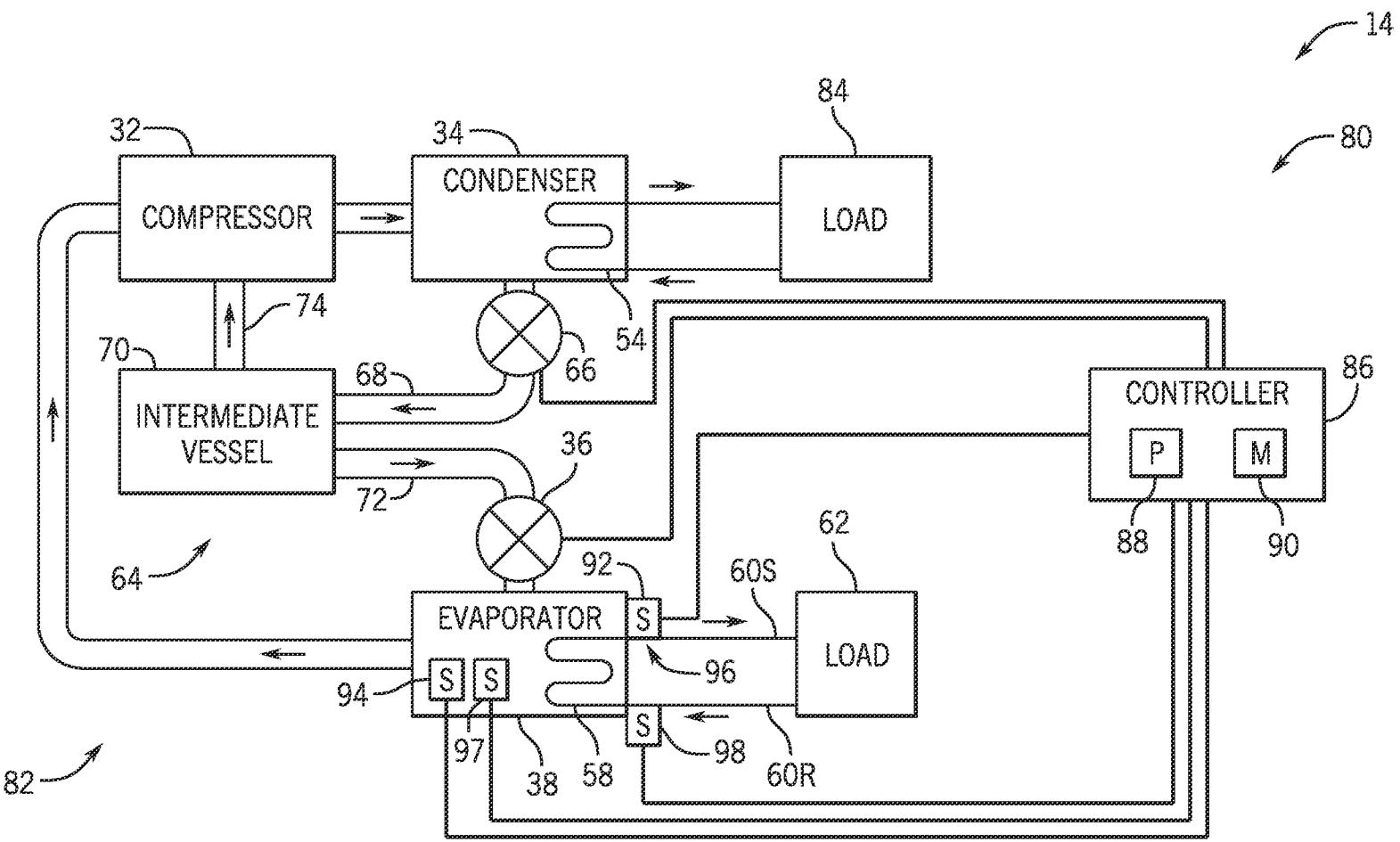
FIG. 5 is a schematic diagram of an embodiment of a vapor compression system having an expansion valve control system, in accordance with an aspect of the present disclosure.

FIG. 5 is a schematic diagram illustrating an embodiment of the vapor compression system 14, illustrating an expansion valve control system 80 incorporated with the vapor compression system 14. The expansion valve control system 80 may control the expansion valve 36 and/or 66 to control pressure(s) and/or phase(s) of the refrigerant along the circuit of the vapor compression system 14 (e.g., within the condenser 34, within the evaporator 38, and/or at other portions of the vapor compression system 14). As generally described above, the vapor compression system 14 may circulate refrigerant along a refrigerant circuit 82 including the compressor 32, the condenser 34, the expansion valve 66, the intermediate vessel 70, the expansion valve 36, and the evaporator 38. Within the condenser 34, the refrigerant may be a refrigerant vapor that transfers heat to a cooling fluid (e.g., water or air) directed through or across the condenser 34. The refrigerant vapor may condense to a refrigerant liquid in the condenser 34 as a result of thermal heat transfer with the cooling fluid. In the illustrated embodiment of FIG. 5, the condenser 34 includes the tube bundle 54 connected to a heating load 84. In certain embodiments, the heating load 84 may be a hot water coil in an air handling unit.

The refrigerant liquid from the condenser 34 flows through the intermediate circuit 64 (e.g., and the intermediate vessel 70) and to the compressor 32 and/or to the evaporator 38. As described above, the expansion valve 66 of the intermediate circuit 64 is configured to lower the pressure of the refrigerant liquid received from the condenser 34. During the expansion process, a portion of the liquid may vaporize, and thus, the intermediate vessel 70 may operate to separate the refrigerant vapor from the refrigerant liquid received from the expansion valve 66. Additionally, the intermediate vessel 70 may provide for further expansion of the refrigerant liquid due to a pressure drop experienced by the refrigerant liquid when entering the intermediate vessel 70. The vapor in the intermediate vessel 70 may be drawn into the compressor 32. The liquid from intermediate vessel 70 may then flow through the expansion valve 36 to the evaporator 38. Accordingly, the intermediate circuit 64 and the expansion valve 36 enable the vapor compression system 14 to maintain and/or adjust certain phase(s) of the refrigerant along certain portions of the refrigerant circuit 82. More specifically, at least partially opening and/or closing the expansion valves 36 and/or 66 may adjust and/or maintain phases (e.g., a ratio of vapor and liquid amounts) of the refrigerant within the condenser 34 and/or the evaporator 38 (e.g., to provide refrigerant in a vapor phase entering the condenser 34 and provide refrigerant in liquid phase entering the evaporator 38).

The expansion valve control system 80 includes a controller 86 configured to control operations of the refrigerant circuit 82, and the vapor compression system 14 generally, based on feedback indicative of operating parameters of the vapor compression system 14. The controller 86 includes processing circuitry 88 and a memory 90. The memory 90 may store instructions executable by the processing circuitry 88 for controlling components of the refrigerant circuit 82. Specifically, the vapor compression system 14 may be controlled by the controller 86 based on feedback indicative of a temperature of the conditioning fluid (e.g., water) exiting the evaporator 38, as detected by a sensor 92 (e.g., a temperature sensor), and/or based on feedback indicative of a pressure of the refrigerant within the evaporator 38, as detected by a sensor 94 (e.g., a pressure sensor). The sensor 92 is disposed at an outlet 96 (e.g., a condoning fluid outlet of the evaporator 38) configured to direct the conditioning fluid from the evaporator 38 and into the supply line 60S. Additionally, the sensor 92 is communicatively coupled to the controller 86, such that the sensor 92 may output a signal indicative of the temperature of the conditioning fluid exiting the evaporator 38 to the controller 86. In some embodiments, the sensor 92 may be a thermocouple and/or another suitable device configured to provide feedback indicative of temperature of the conditioning fluid exiting the evaporator 38. The sensor 94 may be disposed within the evaporator 38 and communicatively coupled to the controller 86, such that the sensor 94 may output a signal indicative of the pressure of the refrigerant within the evaporator 38 to the controller 86. In some embodiments, the sensor 94 may be a microelectromechanical system (MEMS) sensor and/or another suitable device configured to provide feedback indicative of pressure of the refrigerant within the evaporator 38. The vapor compression system 14 may include the sensor 92 and/or the sensor 94.

In some embodiments, the memory 90 of the controller 86 may include one or more tangible, non-transitory, computer-readable media that store instructions executable by the processing circuitry 88 and/or data to be processed by the processing circuitry 88. For example, the memory 90 may include random access memory (RAM), read-only memory (ROM), rewritable non-volatile memory such as flash memory, hard drives, optical discs, other types of memory, or a combination thereof. The memory 90 may store instructions executable by the processing circuitry 88 to perform some or all of the functions described herein. Additionally, the processing circuitry 88 may include one or more general purpose microprocessors, one or more application specific integrated circuits (ASICs), one or more field programmable logic arrays (FPGAs), or any combination thereof to execute instructions stored in the memory 90.

The processing circuitry 88 may receive feedback indicative of the temperature of the conditioning fluid exiting the evaporator 38 from the sensor 92 (e.g., via a signal from the sensor 92) and feedback indicative of the pressure of the refrigerant within the evaporator 38 from the sensor 94 (e.g., via a signal from the sensor 94). The processing circuitry 88 may determine a saturated temperature of the refrigerant within the evaporator 38 based on the pressure and a type of the refrigerant. For example, the processing circuitry 88 may determine the saturated temperature based on reference tables stored in the memory 90 and/or in another suitable memory/database of the vapor compression system 14. The processing circuitry 88 may determine a temperature difference (e.g., a small temperature difference ("STD"), temperature differential, etc.) between the temperature of the conditioning fluid exiting the evaporator 38 and the saturated temperature of the refrigerant and may determine whether the temperature difference is greater than or less than a temperature difference set point (e.g., an STD set point, an STD reference value, temperature differential setpoint, etc.). In some embodiments, the temperature difference set point may be a specific (e.g., pre-determined) set point that enhances or improves the operation (e.g., capacity) of the evaporator 38 (e.g., an amount of refrigerant vaporized per unit of time, such as kilograms per hour) and/or based on a type of the refrigerant, a type of the conditioning fluid, a size and/or type of the evaporator 38, a type of the cooling load 62, a type of the heating load 84, frequency(ies) at which the sensors 92 and/or 94 provide feedback, and/or other aspects and operating parameters of the vapor compression system 14. In some embodiments, the temperature difference set point may be between (e.g., a value between) 0 degrees Celsius and 10 degrees Celsius, between 0 degrees Celsius and 5 degrees Celsius, between 0 degrees Celsius and 3 degrees Celsius, between 0 degrees Celsius and 2 degrees Celsius, 1 degree Celsius, 1.2 degrees Celsius, 1.3 degrees Celsius, 1.4 degrees Celsius, 1.5 degrees Celsius, 1.6 degrees Celsius, 1.7 degrees Celsius, 1.8 degrees Celsius, 2 degrees Celsius, or other suitable temperature or temperature range. In certain embodiments, the temperature difference set point may correspond to a value indicative of or associated with maintaining an outlet temperature of the conditioning fluid exiting the evaporator 38 between 5 degrees Celsius and 25 degrees Celsius, between 5 degrees Celsius and 10 degrees Celsius, 6 degrees Celsius, or any other suitable temperature or temperature range.

Based on the comparison of the temperature difference (e.g., the STD) of the temperature of the conditioning fluid exiting the evaporator 38 at the outlet 96 and the saturated temperature of the refrigerant within the evaporator 38 to the temperature difference set point, the processing circuitry 88 may adjust operation of (e.g., a position of) the expansion valve 36, in accordance with the present techniques. For example, based on a determination that the temperature difference (e.g., STD) is greater than the temperature difference set point, the processing circuitry 88 may output a signal (e.g., to the expansion valve 36) indicative of instructions to open the expansion valve 36 (e.g., adjust the expansion valve 36 towards an open position or fully open position). In this way, the pressure of the refrigerant within the evaporator 38 may be increased and/or the temperature difference between the outlet temperature of the conditioning fluid and the saturated temperature of the refrigerant within the evaporator 38 may be decreased. Additionally or alternatively, adjusting the expansion valve 36 towards the open position may increase a flow rate of the refrigerant into the evaporator 38 and/or may increase a liquid level of refrigerant in the evaporator 38.

Based on a determination that the temperature difference (e.g., the STD) is less than the temperature difference set point, the processing circuitry 88 may output a signal (e.g., to the expansion valve 36) indicative of instructions to close the expansion valve 36 (e.g., move the expansion valve 36 towards a closed position or fully closed position). As a result, the pressure of the refrigerant within the evaporator 38 may be decreased and/or the temperature difference between the outlet temperature of the conditioning fluid and the saturated temperature of the refrigerant within the evaporator 38 may be increased. Additionally or alternatively, adjusting the expansion valve 36 towards the closed position may decrease the flow rate of the refrigerant into the evaporator 38 and/or may decrease the liquid level of refrigerant within the evaporator 38.

By at least partially opening and/or closing the expansion valve 36 in the manner described above, the expansion valve control system 80 is configured to adjust the temperature difference (e.g., STD) toward the temperature difference set point. In other words, the expansion valve control system 80 is configured to at least partially adjust and/or maintain the liquid phase of the refrigerant within the evaporator 38, improve the capacity of the evaporator 38, and/or improve the operation and efficiency of the vapor compression system 14 generally. For example, by adjusting the temperature difference toward the temperature difference set point, the expansion valve control system 80 may enhance an ability of the evaporator 38 to exchange heat with the conditioning fluid circulating through the evaporator 38 and the cooling load 62, thereby enhancing the capacity of the evaporator 38. Additionally or alternatively, by controlling the expansion valve 36 in the manner described above, the expansion valve control system 80 is configured to control the liquid level of refrigerant in the intermediate vessel 70 and/or in the evaporator 38.

In certain embodiments, the processing circuitry 88 may iteratively and/or periodically adjust operation (e.g., position) of the expansion valve 36 (e.g., toward an open or closed position) based on the feedback indicative of the conditioning fluid outlet temperature and the refrigerant pressure in the evaporator 38. For example, the processing circuitry 88 may adjust the position of the expansion valve 36 each time new and/or updated feedback is received from the sensor 92 and/or the sensor 94, one or more times per second, one or more times per minute, one or more times per hour, one or more times per day, or other suitable periods of time or other suitable frequencies.

In certain embodiments, the temperature difference set point (e.g., set point value) may be fixed, and in other embodiments, the temperature difference set point (e.g., set point value) may be variable. In some embodiments, a variable temperature difference set point may be a function of evaporator 38 capacity, which may be estimated (e.g., via the processing circuitry 88) based on conditioning fluid flow measurement(s) through the evaporator 38 and/or a conditioning fluid temperature difference(s) across the evaporator 38. For example, the processing circuitry 88 may determine the variable temperature difference set point to vary proportionally relative to the evaporator 88 capacity. The processing circuitry 88 may determine the capacity of the evaporator 38 based on an inlet pressure of the refrigerant, an outlet pressure of the refrigerant, a pressure of the refrigerant within the evaporator 38, a nominal pressure of the refrigerant within the evaporator 38, an inlet temperature of the conditioning fluid, an outlet temperature of the conditioning fluid, a temperature of the conditioning fluid within the evaporator 38, a pressure drop of the conditioning fluid across the evaporator 38, a volume flow of the conditioning fluid within the evaporator 38, a nominal temperature of the conditioning fluid, and/or any combination thereof.

In certain embodiments, the vapor compression system 14 may include a sensor 97 disposed at the evaporator 38 and configured to detect one or more of the parameters described above relative to determining the capacity of the evaporator 38. For example, the sensor 97 may include a temperature sensor configured to collect data indicative of the temperature of the conditioning fluid in the evaporator 38 and to provide the data to the processing circuitry 88. In other embodiments, the sensor 97 may be another type of sensor configured to provide data indicative of one or more of the other parameters described above for determining the capacity of the evaporator. In certain embodiments, the sensor 97 may include multiple and/or different types of sensors disposed at the evaporator 38, such as temperature sensor(s), pressure sensor(s), and/or other suitable types of sensors. Additionally, while the sensor 97 is illustrated as being disposed in the evaporator 38, the sensor 97 may be positioned at least partially outside the evaporator 38, on the evaporator 38, apart from the evaporator 38, and/or at another suitable location relative to the evaporator 38 and/or other portion(s) of the vapor compression system 14. Accordingly, the processing circuitry 88 may receive the data from the sensor 97 and determine the capacity of the evaporator 38 and/or the variable temperature difference set point based on the received data. The processing circuitry 88 may determine the temperature difference set point based on one or more types of feedback described herein periodically, such as one or more times per second, one or more times per minute, one or more times per hour, one or more times per day, or other suitable periods of time.

In some embodiments, the processing circuitry 88 may adjust operation of the expansion valve 36 based on a determination that the temperature difference (e.g., the STD between the temperature of the conditioning fluid exiting the evaporator 38 at the outlet 96 and the saturated temperature of the refrigerant within the evaporator 38) differs from the temperature difference set point by a threshold value. For example, based on a determination that the temperature difference (e.g., STD) varies from the temperature difference set point by more than the threshold value and that the temperature difference is greater than the temperature difference set point, the processing circuitry 88 may output a signal (e.g., to the expansion valve 36) indicative of instructions open the expansion valve 36 and/or increase a size of a refrigerant flow path through the expansion valve 36. Based on a determination that the temperature difference varies from the temperature difference set point by more than the threshold value and that the temperature difference is less than the temperature difference set point, the processing circuitry 88 may output a signal (e.g., to the expansion valve 36) indicative of instructions to close the expansion valve 36 and/or decrease a size of the refrigerant flow path through the expansion valve 36. In certain embodiments, the processing circuitry 88 may determine (e.g., calculate) the threshold value based on a type of the refrigerant, a type of the conditioning fluid, a size and/or type of the evaporator 38, a type of the cooling load 62, a type of the heating load 84, frequencies at which the sensors 92 and/or 94 provide feedback, and/or other aspects and operating parameters of the vapor compression system 14.

In addition to or instead of adjusting operation of the expansion valve 36, the expansion valve control system 80 may be configured to adjust operation of the expansion valve 66 based on a determination that the temperature difference (e.g., STD) is greater than or less than the temperature difference set point. For example, the expansion valve control system 80 may adjust operation of the expansion valve 66 in embodiments of the vapor compression system 14 including the intermediate circuit 64 (e.g., in addition to or in place of an adjustment to the operation of the expansion valve 36). Based on a determination that the temperature difference is greater than the temperature difference set point, the processing circuitry 88 may output a signal (e.g., to the expansion valve 66) indicative of instructions to adjust the expansion valve 66 towards an open position or a fully open position. Based on a determination that the temperature difference is less than the temperature difference set point, the processing circuitry 88 may output a signal (e.g., to the expansion valve 66) indicative of instructions adjust the expansion valve 66 towards a closed position or fully closed position. Control of the expansion valve 66 in accordance with the present techniques may enable control of the refrigerant liquid level in the condenser 34 and/or in the intermediate vessel 70. Indeed, as described herein, the expansion valve control system 80 is configured to control the expansion valve 36 and/or the expansion valve 66 (e.g., control and/or adjust respective positions of the expansion valves 36 and 66) based on the comparison of the temperature difference to the temperature difference set point to enable control of the refrigerant liquid level in the condenser 34, the intermediate vessel 70, and/or the evaporator 38 without liquid level sensing (e.g., in the condenser 34, the intermediate vessel 70, and/or the evaporator 38), such as via a liquid level sensor. As will be appreciated, the control techniques disclosed herein may enable desired adjustment and/or control of liquid refrigerant levels within the vapor compression system 14 in a manner that is not susceptible to inconsistencies, unreliability, and/or uncertainties that may be associated with reliance on liquid level sensor feedback.

In certain embodiments, the processing circuitry 88 may determine the temperature difference described above as a logarithmic mean temperature difference ("LMTD") and adjust operation of the expansion valve 36 based on the LMTD. For example, the processing circuitry 88 may determine the temperature difference as the LMTD based on an inlet temperature of the conditioning fluid, an outlet temperature of the conditioning fluid (e.g., the temperature of the conditioning fluid exiting the evaporator 38 received from the sensor 92), and an evaporation temperature of the refrigerant (e.g., a saturated temperature of the refrigerant within the evaporator 38, which may be determined based on a type of the refrigerant and/or the pressure of the refrigerant within the evaporator 38 received from the sensor 94). Based on a comparison of the temperature difference (e.g., the LMTD) to a temperature difference set point, the processing circuitry 88 may adjust operation of the expansion valve 36. For example, based on a determination that the temperature difference is greater than the temperature difference set point, the processing circuitry 88 may output a signal (e.g., to the expansion valve 36) indicative of instructions open the expansion valve 36 (e.g., move the expansion valve 36 towards an open position or fully open position). Based on a determination that the temperature difference is less than the temperature difference set point, the processing circuitry 88 may output a signal (e.g., to the expansion valve 36) indicative of instructions close the expansion valve 36 (e.g., move the expansion valve 36 towards a closed position or fully closed position). In some embodiments, the processing circuitry 88 may additionally or alternatively adjust operation of the expansion valve 66 based on a determination that the temperature difference (e.g., the LMTD) is greater than or less than the temperature difference set point, such as in addition to or instead of adjusting operation of the expansion valve 36. In certain embodiments, the processing circuitry 88 may determine the LMTD as a function of the evaporator 38 capacity, a heat transfer coefficient associated with the evaporator 38, and/or a heat transfer surface area of the evaporator 38. For example, LMTD may vary proportionally relative to the evaporator 38 capacity and based on the heat transfer coefficient and the heat transfer surface area (e.g., as the evaporator 38 capacity increases or decreases, the LMTD may increase or decrease, respectively).

In some embodiments, the expansion valve control system 80 and/or the vapor compression system 14 may include a sensor 98 (e.g., a temperature sensor) disposed at an inlet of the evaporator 38 (e.g., a sensor disposed along the return line 60R of the tube bundle 58). As illustrated, the sensor 98 is communicatively coupled to the controller 86, such that the sensor may output a signal indicative of the temperature of the conditioning fluid entering the evaporator 38 to the controller 86. In some embodiments, the sensor 98 may be a thermocouple and/or another suitable device configured to provide feedback indicative of temperature of the conditioning fluid entering the evaporator 38.

Figure 6:
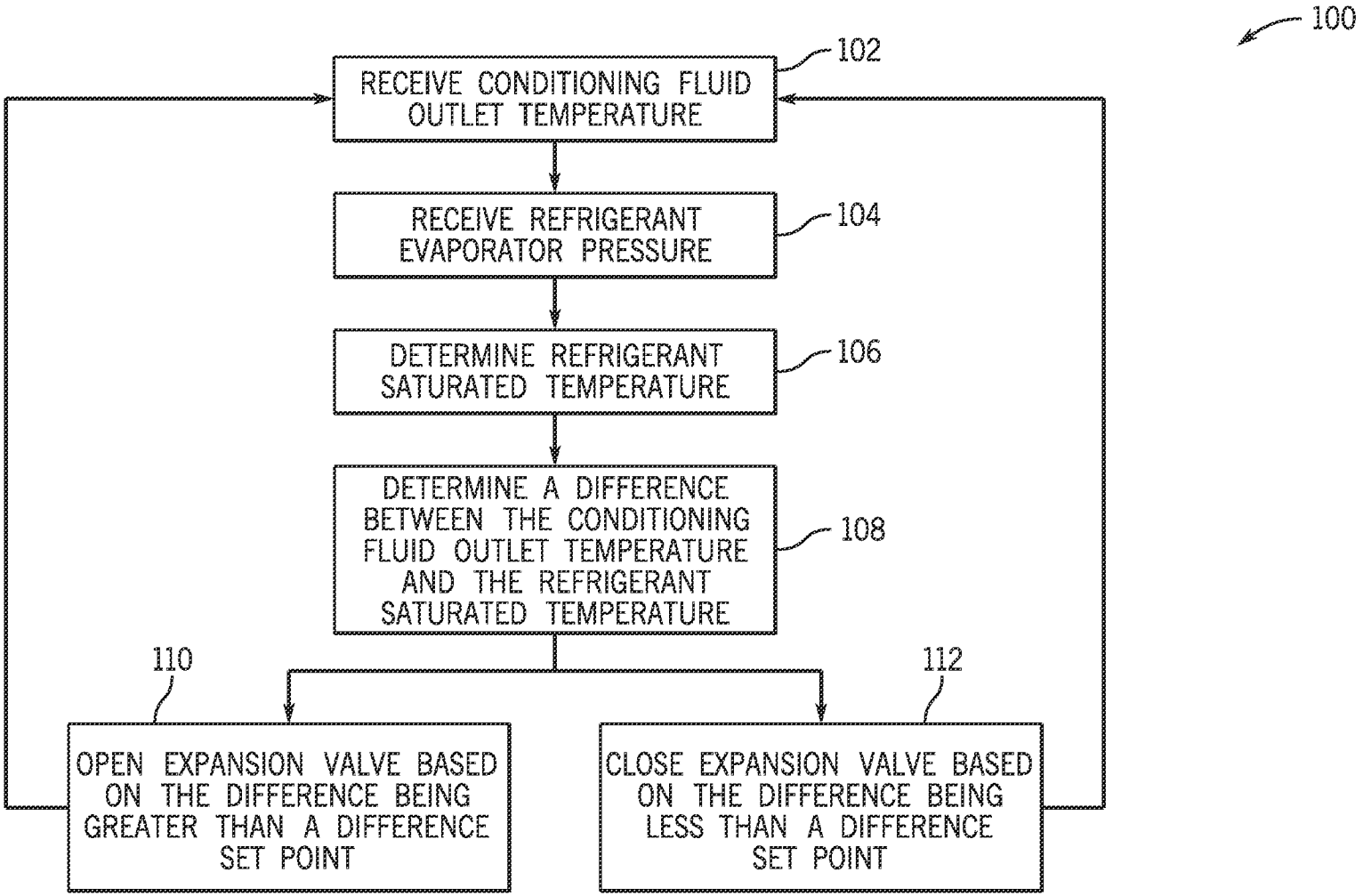
FIG. 6 is a flow chart illustrating an embodiment of a process for operating a vapor compression system, in accordance with an aspect of the present disclosure.

FIG. 6 is a flow chart illustrating an embodiment of a process 100 for operating the expansion valve control system 80 of the vapor compression system 14. It is to be understood that the steps discussed herein are merely exemplary, and certain steps may be omitted or performed in a different order than the order described below. Additionally, as generally described above, the process 100, or portions thereof, may be iteratively and/or periodically performed by the expansion valve control system 80 to facilitate maintenance of and/or adjustment of phases, temperatures, pressures, and/or levels of the refrigerant at certain points or portions along the refrigerant circuit 82. In some embodiments, the process 100 may be stored in the memory 90 and executed by the processing circuitry 88 of the controller 86 or stored in other suitable memory and executed by other suitable processing circuitry of the expansion valve control system 80.

As shown in the illustrated embodiment of FIG. 6, at block 102, the expansion valve control system 80, via the processing circuitry 88, receives feedback indicative of the temperature of the conditioning fluid exiting the evaporator 38 from the sensor 92. At block 104, the processing circuitry 88 receives feedback indicative of the pressure of the refrigerant within the evaporator 38 from the sensor 94. At block 106, the processing circuitry 88 determines the saturated temperature of the refrigerant within the evaporator 38 based on the refrigerant pressure and the type of refrigerant. As described above, the processing circuitry 88 may determine the saturated temperature based on reference tables stored in the memory 90 and/or in another suitable memory/database of the vapor compression system 14. Each reference table may suitable for determining the saturated temperature of a specific type of refrigerant.

At block 108, the processing circuitry 88 determines a temperature difference between the temperature of the conditioning fluid exiting the evaporator 38 and the saturated temperature of the refrigerant within the evaporator 38. The processing circuitry 88 compares the temperature difference to a temperature difference set point and determines if the temperature difference is greater than or less than the temperature difference set point. As described above, the processing circuitry 88 may determine the temperature difference set point as a set point value that improves or enhances the capacity of the evaporator 38 and/or based on a type of the refrigerant, a type of the conditioning fluid, a size and/or type of the evaporator 38, a type of the cooling load 62, a type of the heating load 84, frequencies at which the sensors 92 and/or 94 provide feedback, and/or other aspects and operating parameters of the vapor compression system 14. Based on the temperature difference being greater than the temperature difference set point, the process 100 proceeds to block 110, and the expansion valve control system 80 adjusts the expansion valve 36 and/or the expansion valve 66 toward an open position (e.g., a fully open position) to enable refrigerant to flow into the evaporator 38 and/or to increase a flow rate of refrigerant into the evaporator 38. Based on the temperature difference being less than the temperature difference set point, the process 100 proceeds to block 112, and the expansion valve control system 80 adjusts the expansion valve 36 and/or the expansion valve 66 toward a closed position (e.g., a fully closed position) to block refrigerant from flowing into the evaporator 38 and/or to decrease the flow rate of refrigerant into the evaporator 38.

Accordingly, the present disclosure is directed to an expansion valve control system for a vapor compression system. The expansion valve control system includes sensors configured to provide feedback indicative of an outlet temperature of conditioning fluid exiting an evaporator and a refrigerant pressure within the evaporator. Based on the refrigerant pressure within the evaporator and/or other factors, a controller of the expansion valve control system (e.g., via a processing circuitry) determines a saturated temperature of the refrigerant. Additionally, the controller determines a temperature difference between the conditioning fluid outlet temperature and the refrigerant saturated temperature. Based on the temperature difference being greater than a temperature difference set point, the controller may adjust an expansion valve disposed upstream of the evaporator toward an open position, thereby increasing the pressure of the refrigerant within the evaporator and decreasing the difference between the conditioning fluid outlet temperature and the refrigerant saturated temperature. Based on the temperature difference being less than the temperature difference set point, the controller may adjust the expansion valve toward a closed position, thereby decreasing the pressure of the refrigerant within the evaporator and increasing the difference between the conditioning fluid outlet temperature and the refrigerant saturated temperature. The temperature difference set point may be a specific set point that improves or enhances operation (e.g., the capacity) of the evaporator. Accordingly, as the controller adjusts operation of the expansion valve, the controller may enhance the capacity of the evaporator and improve the efficiency of the vapor compression system generally. Further, the techniques disclosed herein do not utilize feedback from a liquid level sensor, which may not be reliable in some circumstances. Accordingly, the present systems and methods enable improved adjustment and operation of the vapor compression system.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A vapor compression system, comprising:

a heat exchanger configured to facilitate heat transfer between a refrigerant and a conditioning fluid;

an expansion valve disposed along a conduit coupled to the heat exchanger, wherein the conduit is configured to direct a flow of the refrigerant into the heat exchanger;

a sensor configured to provide feedback indicative of a temperature of the conditioning fluid exiting the heat exchanger; and a controller comprising a memory and processing circuitry, wherein the processing circuitry is configured to:

receive a signal indicative of the temperature of the conditioning fluid exiting the heat exchanger from the sensor;

determine a temperature difference between the temperature of the conditioning fluid exiting the heat exchanger and a saturated temperature of the refrigerant in the heat exchanger;

adjust operation of the expansion valve based on a comparison of the temperature difference and a temperature difference set point, wherein the temperature difference set point is a variable temperature difference set point; and adjust a value of the variable temperature difference set point based on data indicative of a capacity of the heat exchanger.

2. The vapor compression system of claim 1, wherein the processing circuitry is configured to:

output a signal indicative of instructions to adjust the expansion valve toward a closed position based on a determination that the temperature difference is less than the variable temperature difference set point; and output a signal indicative of instructions to adjust the expansion valve toward an open position based a determination that the temperature difference is greater than the variable temperature difference set point.

3. The vapor compression system of claim 1, wherein the processing circuitry is configured to:

receive a signal indicative of a pressure of the refrigerant within the heat exchanger; and determine the saturated temperature of the refrigerant based on the pressure of the refrigerant within the heat exchanger.

4. The vapor compression system of claim 3, wherein the sensor comprises a first sensor, and the vapor compression system comprises a second sensor configured to provide feedback indicative of the pressure of the refrigerant within the heat exchanger.

5. The vapor compression system of claim 1, wherein a value of the variable temperature difference set point is between zero degrees Celsius and five degrees Celsius.

6. The vapor compression system of claim 1, wherein the processing circuitry is configured to estimate the capacity of the heat exchanger based on a parameter of the conditioning fluid exiting the heat exchanger.

7. The vapor compression system of claim 1, wherein the heat exchanger comprises an evaporator configured to transfer heat from the conditioning fluid to the refrigerant.

8. The vapor compression system of claim 1, comprising a cooling load, wherein the vapor compression system is configured to circulate the conditioning fluid through tubing of the heat exchanger and through the cooling load.

9. A vapor compression system, comprising:

a condenser configured to transfer heat from a refrigerant to a cooling fluid;

an evaporator configured to transfer heat from the refrigerant to a conditioning fluid;

an expansion valve configured to direct the refrigerant from the condenser to the evaporator;

a sensor configured to provide feedback indicative of a temperature of the conditioning fluid exiting the evaporator; and a controller comprising a memory and processing circuitry, wherein the processing circuitry is configured to:

receive a signal from the sensor indicative of the temperature of the conditioning fluid exiting the evaporator;

determine a temperature difference between the temperature of the conditioning fluid exiting the evaporator and a saturated temperature of the refrigerant within the evaporator;

adjust operation of the expansion valve based on a comparison of the temperature difference and a temperature difference set point, wherein the temperature difference set point is a variable temperature difference set point; and adjust a value of the variable temperature difference set point based on data indicative of a capacity of the evaporator.

10. The vapor compression system of claim 9, wherein the processing circuitry is configured to:

output a signal indicative of instructions to adjust the expansion valve towards an open position based on a determination that the temperature difference is greater than the variable temperature difference set point; and output a signal indicative of instructions to adjust the expansion valve towards a closed position based on a determination that the temperature difference is less than the variable temperature difference set point.

11. The vapor compression system of claim 9, wherein the sensor is a first sensor, and the vapor compression system comprises a second sensor configured to provide feedback indicative of a pressure of the refrigerant within the evaporator, and wherein the processing circuitry is configured to determine the saturated temperature of the refrigerant based on the pressure of the refrigerant.

12. The vapor compression system of claim 9, wherein the value of the variable temperature difference set point is between zero degrees Celsius and two degrees Celsius.

13. The vapor compression system of claim 9, wherein the processing circuitry is configured to determine the value of the variable temperature difference set point based on a type of the refrigerant, a type of the conditioning fluid, a size of the evaporator, a type of the evaporator, or a combination thereof.

14. The vapor compression system of claim 9, comprising a heating load, wherein the vapor compression system is configured to direct the cooling fluid through the heating load and the condenser.

15. The vapor compression system of claim 14, comprising a cooling load, wherein the vapor compression system is configured to direct the conditioning fluid through the cooling load and the evaporator.

16. A method of controlling an expansion valve of a vapor compression system, the method comprising:

detecting a temperature of a conditioning fluid exiting a heat exchanger;

determining a temperature difference between the temperature of the conditioning fluid and a saturated temperature of a refrigerant within the heat exchanger;

adjusting the expansion valve toward a closed position based on a determination that the temperature difference is less than a temperature difference set point, wherein the temperature difference set point is a variable temperature difference set point;

adjusting a value of the variable temperature difference set point based on data indicative of a capacity of the heat exchanger; and adjusting the expansion valve toward an open position based on a determination that the temperature difference is greater than the variable temperature difference set point.

17. The method of claim 16, comprising:

detecting a pressure of the refrigerant within the heat exchanger; and determining the saturated temperature of the refrigerant based on the pressure of the refrigerant within the heat exchanger and based on a type of the refrigerant.

18. The method of claim 16, comprising estimating the capacity of the heat exchanger based on a pressure of the refrigerant at a first inlet of the heat exchanger, a pressure of the refrigerant at a first outlet of the heat exchanger, a pressure of the refrigerant within the heat exchanger, a nominal pressure of the refrigerant within the heat exchanger, a temperature of the conditioning fluid at a second inlet of the heat exchanger, a temperature of the conditioning fluid at a second outlet of the heat exchanger, a temperature of the conditioning fluid within the heat exchanger, a pressure differential of the conditioning fluid across the heat exchanger, a volume flow rate of the conditioning fluid within the heat exchanger, a nominal temperature of the conditioning fluid, or a combination thereof.

* * * * *